US005520537A

United States Patent [19]

Taylor

[11] Patent Number: 5,520,537

[45] **Date of Patent: * May 28, 1996**

[54] HIGH-OUTPUT TUBE BURNER

[75] Inventor: Curtis L. Taylor, Muncie, Ind.

[73] Assignee: Maxon Corporation, Muncie, Ind.

[ * ] Notice: The portion of the term of this patent subsequent to Mar. 21, 2012, has been disclaimed.

[21] Appl. No.: 297,385

[22] Filed: Aug. 29, 1994

Related U.S. Application Data

[63] Continuation of Ser. No. 253,965, Jun. 3, 1994, Pat. No. 5,399,085, which is a continuation-in-part of Ser. No. 909, 967, Jul. 7, 1992, abandoned.

[51] Int. Cl.[6] ..... F23D 14/58; F23D 14/22

[52] U.S. Cl. ..... 431/353; 431/8; 431/243

[58] Field of Search ..... 431/350, 353, 431/352, 243, 8

[56] References Cited

U.S. PATENT DOCUMENTS

| | | | |
|---|---|---|---|
| 3,265,113 | 8/1966 | Thurley et al. . | |
| 3,266,550 | 8/1966 | Sick et al. . | |
| 3,574,508 | 4/1971 | Rothhaar et al. . | |
| 3,993,449 | 11/1976 | Childs . | |
| 4,007,002 | 2/1977 | Schirmer | 431/352 X |
| 4,014,316 | 3/1977 | Jones et al. . | |
| 4,124,353 | 11/1978 | Prudhon et al. . | |
| 4,518,348 | 5/1985 | Wedge et al. . | |
| 4,752,211 | 6/1988 | Sabin . | |
| 5,055,032 | 10/1991 | Altemark et al. . | |

FOREIGN PATENT DOCUMENTS

| | | |
|---|---|---|
| 462695A | 12/1991 | European Pat. Off. . |
| 2584800A | 1/1987 | France . |
| 2724937 | 12/1978 | Germany . |
| 1079952A | 3/1984 | U.S.S.R. . |
| 1278539A | 12/1986 | U.S.S.R. . |

OTHER PUBLICATIONS

Type CX Gas Small Diameter Tube Burner, Power Flame Incorporated Bulletin, CX-189, Rev. 789 (1989).

*Eclipse Immerso-Jet Burner,* Eclipse Combustion Bulletin, Spec 330 Oct. 1989.

*Eclipse Immerso-Jet,* Eclipse Combustion Bulletin, H-80C Sep. 1988.

*Primary Examiner*—Carl D. Price

*Attorney, Agent, or Firm*—Barnes & Thornburg

[57] ABSTRACT

A burner assembly combines air and fuel to produce a burn firing into a downstream tube. The assembly includes a funnel formed to include an inlet, an outlet, and an air and fuel mixing region therebetween. The funnel also includes a cylindrical intake end at the inlet and a conical side wall mating with the cylindrical intake end and converging from the cylindrical intake end toward the outlet to fire a burn initiated in the mixing region into a tube coupled to the outlet of the funnel. The assembly also includes a system for supplying a gaseous fuel to the mixing region in the funnel and a system for introducing combustion air into the mixing region through the inlet of the funnel. The combustion air mixes with the gaseous fuel in the mixing region to produce a combustible mixture. The combustible mixture in the funnel is ignited to fire a burn into the downstream tube, which tube is coupled to the outlet end of the funnel and extended into the interior solution-containing region of an adjacent solution tank, so that combustion begins, progresses, and transitions gradually into the downstream tube.

17 Claims, 6 Drawing Sheets

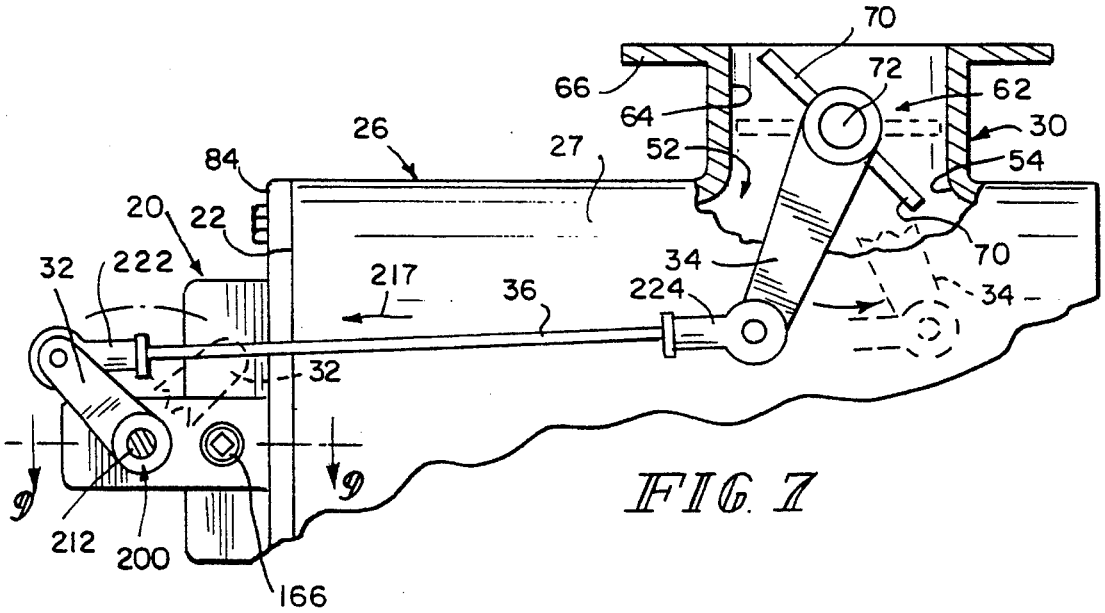
FIG. 7
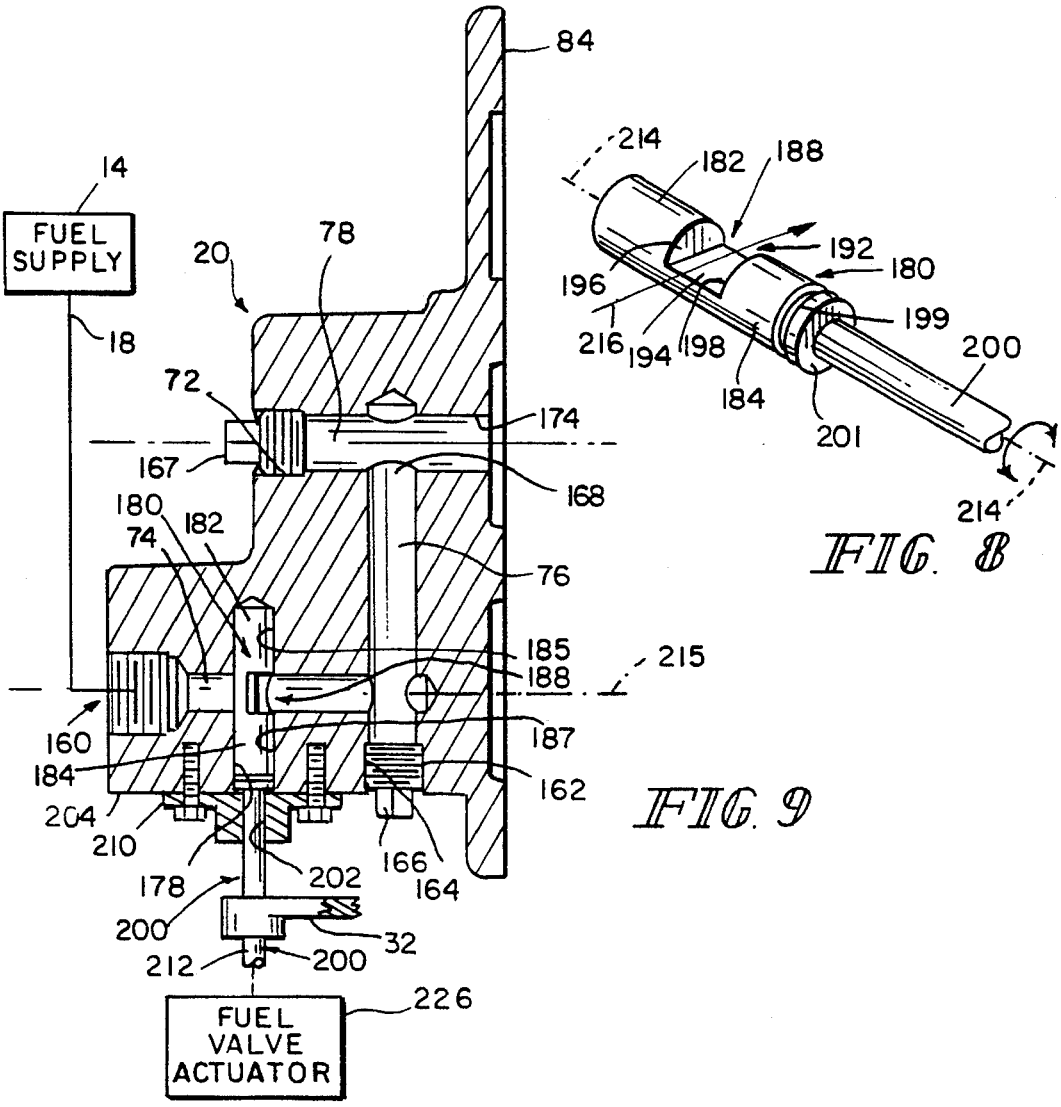
FIG. 8
FIG. 9

HIGH-OUTPUT TUBE BURNER

This is a continuation of application Ser. No. 08/253,965 filed Jun. 3, 1994, now U.S. Pat. No. 5,399,085 which is a CIP of Ser. No. 07/909,967, filed Jul. 7, 1992, (now abandoned).

BACKGROUND AND SUMMARY OF THE INVENTION

The present invention relates to burner assemblies and particularly to high capacity tube-fired burners. More particularly, the present invention relates to an immersion tube burner including a combustion chamber for burning a combustible air and fuel mixture and an immersion tube heat exchanger.

Immersion tube burners are used in a variety of industrial processes to heat solution tanks containing liquid. It is often necessary to heat liquids such as water for parts cleaning or chemical baths for parts treating or plating. It is known to mount an immersion tube burner to a liquid-containing solution tank. The burner is arranged so that it fires into one end of a long pipe or serpentine tube which passes through liquid in the solution tank. An outlet end of the tube is connected to an exhaust stack. See, for example, U.S. Pat. No. 4,014,316 to Jones et al.

Typically, tube burners will either use refractory in the combustion chamber or the burner will attach to the wall of the tank so that the combustion chamber is mounted inside the tank. Refractory represents a large initial acquisition expense as well as continuing operating costs due to maintenance and repair. Mounting the combustion chamber in the tank allows the liquid in the tank to provide the cooling necessary to keep the combustion chamber from melting. However, these combustion chambers can range from 8–20 inches (20.3–50.8 cm) in diameter and from 2.5–52 inches (63.5–132.1 cm) in length. Obviously, such chambers represent a large volume of space consumed in the tank.

Eliminating the combustion chamber from the tank would allow for more passes of a smaller diameter tube through the liquid, thereby increasing the overall thermal efficiency of the apparatus. It also allows the use of a smaller tank with associated floor space savings. Doing away with the refractory would decrease initial acquisition expense, save weight, and eliminate maintenance and repair associated with the refractory.

In the past, in order to fire enough gas to achieve the necessary temperatures, high pressure fans and relatively large diameter tubes were used. See, for example, U.S. Pat. No. 4,014,316 to Jones et al which is designed to use "the highest pressure supply normally available." The high pressure fans, because of the size of the fan and associated ducting, represent another major cost factor in terms of acquisition. The larger fans require larger horsepower motors to drive them, and therefore have higher operating expenses.

The large diameter tubes generally ranged between six inches (15.2 cm) and twelve inches (30.5 cm) in diameter. Large diameter tubes can increase costs by as much as a factor of four over a smaller diameter tube just for straight sections, with curves and bends in the tubes costing even more. However, in the past it has been difficult to maintain flame stability when attempting to burn large amounts of fuel in a small diameter tube.

Recognizing the potential for initial acquisition and operational savings, there is a need for a smaller diameter tube burner operating with a low-pressure combustion air source. Such a burner would allow reduction in size of solution tanks and tubing. It would further allow the use of a smaller fan with a smaller horsepower motor and smaller diameter air ducting. A burner that could meet such demand would represent a substantial improvement over a conventional immersion tube burner.

According to the present invention, a burner assembly for combining air and fuel to produce a burn firing into a downstream tube includes a funnel formed to include an inlet end, an outlet end, and an air and fuel mixing region therebetween. The funnel also has a central longitudinal axis and includes a cylindrical intake end at the inlet end and a conical side wall mating with the cylindrical intake end and converging from the cylindrical intake end toward the outlet end to fire a burn initiated in the mixing region into a tube coupled to the outlet end of the funnel.

The burner assembly also includes means for supplying a gaseous fuel to the mixing region in the funnel and means for introducing combustion air into the mixing region through the inlet end of the funnel. The combustion air mixes with the gaseous fuel in the mixing region to produce a combustible mixture. The introducing means includes an air-mixing plate mounted in the inlet end of the funnel. The air-mixing plate is formed to include a plurality of air supply apertures passing combustion air into the mixing region.

The burner assembly also includes means for igniting the combustible mixture in the funnel to fire a burn into the downstream tube, which tube is coupled to the outlet end of the funnel and extended into the interior solution-containing region of an adjacent solution tank, so that combustion begins, progresses, and transitions gradually into the downstream tube. Thus, the combustion reaction is delayed as only a small stabilizing portion of the fuel begins to burn in the funnel and the rest of the fuel burn is delayed until the air and fuel mixture has exited from the downstream of the funnel and entered into the tube mounted in the solution tank.

In preferred embodiments, the introducing means includes a burner housing formed to include a discharge outlet and an interior region containing combustion air. The funnel is located in the interior region of the burner housing to position the air-mixing plate in the interior region so that combustion air is supplied to the mixing region through the apertures in the air-mixing plate. The outlet end of the funnel is coupled to the discharge outlet of the burner housing so that a burn initiated in the mixing region of the funnel is fired into a downstream tube positioned outside the burner housing and coupled to the outlet end of the funnel through the discharge outlet. The design of the burner makes it well-suited to be located outside of a tank containing liquid to be heated and used to fire a burn into a small bore tube heat exchanger situated in the liquid-containing tank.

Gaseous fuel is discharged into the mixing region in the funnel by a fuel discharge nozzle. The nozzle has an annular side wall and a closed end wall. A portion of the annular side wall of the nozzle is formed to include a plurality of gaseous fuel discharge ports that are arranged to discharge gaseous fuel into the mixing region in the funnel. The air-mixing plate is formed to include a central aperture and the fuel discharge nozzle is mounted in the burner assembly to extend through the central aperture and position the gaseous fuel discharge ports and the closed end wall in the mixing region defined by the funnel.

The air-mixing plate is perforated to include supply apertures for passing combustion air into the air and fuel mixing region defined by the funnel. These apertures are arranged in a pattern designed to permit use of low pressure combustion air and generate a burn that can be fired into a small bore tube heat exchanger. The pattern defines several concentric rings of air supply apertures and calls for the apertures in each ring to be spaced apart uniformly about the circumference of each ring. The apertures in the innermost ring of air supply apertures have the smallest internal diameter and the apertures in the outermost ring of air supply apertures have the largest internal diameter. This unique pattern of air supply apertures allows low pressure combustion air passing through the burner housing and swirling around the funnel to pass through the perforated air-mixing plate into the mixing region provided in the funnel to mix with gaseous fuel discharged into the mixing region by the nozzle so that a stable burn is initiated and supported in the mixing region.

By providing combustion air to a "transition" chamber that is defined by a funnel located inside the burner housing, the present invention channels combustion air to pass over and around the funnel to cool the transition chamber defined by the funnel before it reaches the air-mixing plate. By cooling the transition chamber with combustion air, the present invention allows the transition chamber to be located outside the tank containing liquid to be heated, yet avoids the need to use brittle and expensive refractory surface to define the transition chamber. Removing the transition chamber from inside the liquid-containing tank allows a reduction in size of the tank, tubes, and associated equipment. By allowing the use of smaller diameter heat exchanger tubes in the tank, the present invention also provides increased heat transfer efficiency, thereby providing a substantial improvement over conventional gas-fired tube burners.

By providing an air-mixing plate having apertures of various sizes, the present invention allows a sufficient amount of combustion air to be provided to the air and fuel mixing region in the funnel by a low pressure air fan and eliminates the need for a high pressure air fan of the type that is typically used with a conventional small bore immersion heating system. Use of a low pressure air fan allows the use of a burner with combustion air fan and gas/air control devices integral to the burner unit to eliminate the need for high pressure air ducting. At the same time, the design of the air-mixing plate allows cooling combustion air to pass through the transition chamber along the inner wall of the funnel defining the transition chamber to provide additional cooling of the transition chamber and increase control of the burn. The funnel defines a tapered transition chamber converging from its inlet holding the air-mixing plate to its outlet joining the tube heat exchanger. This funnel converges as a selected angle along its length to allow gradual controlled combustion of the air and fuel mixture to provide a higher burner firing rate into a small bore tube heat exchanger. The funnel provides a firing cone which allows combustion to begin, progress, and transition gradually into a small bore tube heat exchanger having a desired internal diameter.

Another aspect of the invention relates to a fuel supply control valve that is included in the fuel-supplying means to regulate flow of gaseous fuel into the air and fuel mixing region in the burner housing. Instead of using a conventional butterfly valve, a slotted shaft-type fuel supply control valve is used to regulate fuel flow into the burner housing. Such a valve is easy to install and replace. Also, the slot in the valve shaft can be sized and arranged to allow a small flow of fuel to be fed into the air and fuel mixing region when the valve is moved to its generally "closed" position. Advantageously, this feature makes it easy for users of the burner assembly 10 to idle the burner at low fire rates rather than shut off the burner completely and therefore require a later reignition sequence to put the burner back in operation. Illustratively, the cylindrically shaped fuel supply control valve is rotated about its longitudinal axis to regulate the flow of fuel into burner housing 26.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 7 is a partial side view showing a control linkage connecting a fuel supply control valve located in a fuel supply apparatus connected to the burner housing and an air supply valve located in the combustion air inlet formed in the burner housing;

FIG. 8 is a perspective view of the fuel supply control valve shown in FIG. 7 and a drive shaft for rotating the fuel supply control valve about its longitudinal axis between opened and closed positions;

FIG. 9 is a section taken along line 9—9 in FIG. 7 showing the interior of the fuel supply apparatus and, particularly, the passageways provided therein to conduct gaseous fuel from the fuel supply to the gaseous fuel nozzle, the placement of the fuel supply control valve in a bore to extend across one of the fuel passageways in the fuel supply apparatus, and the placement of a fuel valve actuator and control linkage outside of the fuel supply apparatus to provide means for rotating the drive shaft and the fuel supply control valve to regulate opening and closing of the fuel supply control valve;

DETAILED DESCRIPTION OF THE DRAWINGS

Figures 1, 2:
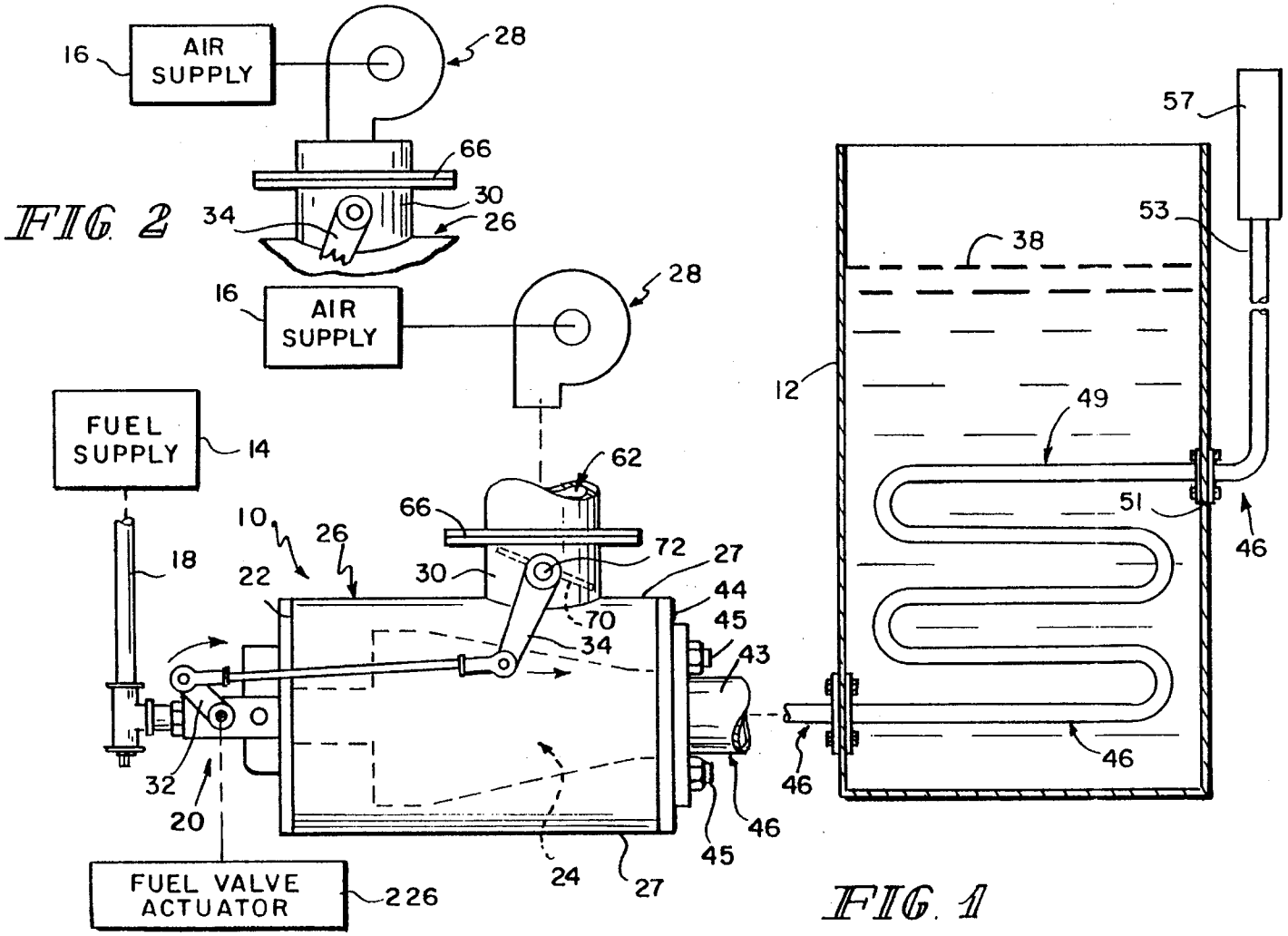
FIG. 1 is a schematic view of a burner assembly in accordance with the present invention showing a burner housing, a fuel supply, an air supply, a combustion air fan, and a tank containing liquid to be heated by a tube heat exchanger connected to the burner assembly.
FIG. 2 is a view of a burner-mounted combustion air fan suitable for use in the burner assembly of FIG. 1.

As shown in FIG. 1, a gas-fired tube burner 10 is used in industrial processes to produce a burn in a tube heat exchanger situated in a tank 12 to heat liquid 38 contained in the tank 12. Gaseous fuel from a fuel supply 14 and combustion air from an air supply 16 is mixed inside a transition chamber 24 provided in the burner 10 to form a combustible mixture and the mixture is ignited using ignition means 82 shown in FIGS. 3 and 4 to initiate the burn. In use, gaseous fuel passes from the fuel supply 14 through a fuel supply conduit 18 to a fuel supply apparatus 20 that is attached to the back end 22 of a burner housing 26. Fuel supply apparatus conducts a measured amount of gaseous fuel to the transition chamber 24 located inside the burner housing 26 and connected to a tube heat exchanger situated in tank 12.

A low horsepower combustion air fan 28, preferably mounted on the burner housing 26 as shown in FIG. 2, supplies combustion air at a pressure of about six inches of water column from an air supply 16 to a combustion air inlet 30 formed in a side wall 27 of the burner housing 26. Pivot links 32 and 34 and a control rod 36 form a control linkage connecting a butterfly valve 70 mounted in the combustion air inlet 30 to a rotatable fuel supply control valve 188 and drive shaft 200 mounted in the fuel supply apparatus 20. An operator can operate the control linkage 32, 34, 36 manually or by remote control to regulate the amount of air and fuel flow into the transition chamber 24 easily to ensure that a proper ratio of air and fuel combine in the transition chamber 24 to produce a combustible mixture.

The burn begins (but is not completed) in transition chamber 24 is directed out of the front end 44 of the burner housing 26 and continues into an inlet end 43 of a long tube heat exchanger 46. Thus, combustion is actually taking place outside of burner 10 in the conventional long tube heat exchanger 46 mounted in tank 12 and coupled to burner 10.

Tube heat exchanger 46 includes a serpentine section 49 which winds through the tank 12 and connects to an exit aperture 51. Tube 46 also includes an exhaust tube 53 coupled to the serpentine section 49 at exit aperture 51 and an exhaust stack 57. As shown in FIG. 1, serpentine section 49 is immersed in the liquid 38 contained in tank 12 so that it can function as a heat exchanger to transfer heat from the burn produced by burner 10 partly in transition chamber 24 and partly in tube 46 to the liquid 38 in tank 12.

The burner disclosed in U.S. Pat. No. 4,014,316 to Jones is designed to complete the combustion process inside its external combustion chamber and to pass the exhaust products into the smaller immersed tube. Because of the need to complete combustion inside the external combustion chamber, the burner disclosed in U.S. Pat. No. 4,014,316 to Jones requires a large amount of combustion air pressure to counter the expansion effects in the combustion chamber (approximately six times increase in air/gas volume). This makes it difficult for Jones to use a commercially available "packaged" low pressure combustion air fan which typically has a maximum pressure rating of about six to nine inches of water column. Therefore, a packaged burner system, with its desirable small area requirements, would be impossible.

It would be desirable to decrease the size of a combustion system to satisfy factory floor space restrictions imposed on users of immersion tube burner systems. The development of a burner, like burner 10, that can use a low-pressure packaged blower answers the needs of the market. Illustratively, burner 10 is uniquely configured to initiate combustion in transition chamber 24 and complete the largest portion of the combustion process outside of burner 10 in the immersed tube 46 and is thus able to operate using a low horsepower, burner-mounted, low-pressure combustion air fan.

Conveniently, burner housing 26 is attached to tube heat exchanger 46 using mounting studs 45 that are provided on front end 44 of the burner housing 26. These mounting studs 45 are arranged to mate with apertures formed in a conventional flange 47 that is mounted on tube heat exchanger 46 and provided by the end user. One advantage of burner 10 is that it is configured to mount directly to conventional tube heat exchangers without the need to provide or rely on additional connection devices.

Although reference is made herein to an "immersion" tube burner 10, the low pressure tube-fired burner 10 of the present invention is suitable for use in many other applications that do not require immersion of a tube in a tank of liquid. For example, the tube-fired burner might be used with a fin tube indirect heater or with radiant tubes where heat is given off by the tube to heat a stream of air or nearby material.

Figure 3:
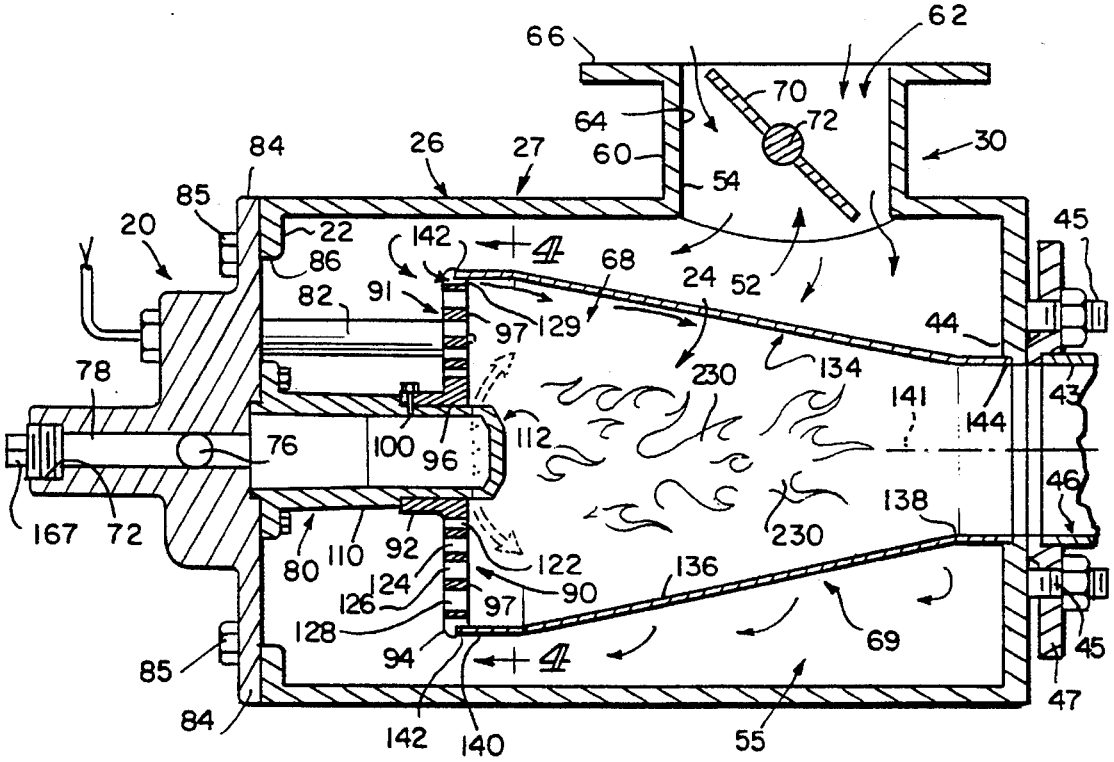
FIG. 3 is an enlarged sectional view of the burner housing of FIG. 1 showing a gaseous fuel nozzle extending into an interior region in the burner housing, an air-mixing plate mounted on the nozzle, a funnel defining an air and fuel mixing region to provide a transition chamber connected to a small bore tube heat exchanger located outside the burner housing, and a valve-controlled combustion air inlet formed in the burner housing.

Referring now to FIG. 3, burner housing 26 includes a cylindrical side wall 27 extending between front end 44 and back end 22. A combustion air inlet aperture 52 is formed in the side wall 27. Side wall 27 and ends 22 and 44 cooperate to define an interior region 55 inside burner housing 26.

A cylindrical combustion air inlet 30 is formed to include an inner end 54 coupled to the burner housing 26 at the combustion air inlet aperture 52, an outer end 64, and a cylindrical side wall 60 extending between the inner end 54 and the outer end 64. The cylindrical side wall 60 defines a combustion air passage 62 for conducting combustion air from air supply 16 and fan 28 into the interior region 55 of the burner housing 26. An annular mounting flange 66 for mounting a combustion air fan 28 on the burner 10 is formed at the outer end 64 of the combustion air inlet 30.

A circular butterfly valve 70 is centrally mounted inside the combustion air passage 62. The diameter of the butterfly valve 70 is substantially equal to the inner diameter of the combustion air passage 62. The butterfly valve 70 is mounted to rotate on an axle 72 that is oriented to lie on an axis transverse to the central axis of the combustion air passage 62. The axle 72 is rotatably coupled to the cylindrical side wall 60 of the combustion air inlet 30 so that the butterfly valve 70 can rotate on the axle 72 between fully closed and opened positions. In the closed position, as shown in FIG. 7, the butterfly valve 70 lies in a plane that is transverse to the central axis of the combustion air passage 62. In the opened position, as shown in FIGS. 3 and 7, the butterfly valve 70 lies in a plane that is at an acute angle to the central axis of the combustion air passage 62.

The fuel supply apparatus 20 is attached to the back end 22 of the burner housing 26 by bolts 85, rivets, or other suitable fastening means. As shown best in FIG. 3, a fuel nozzle 80 and a flame ignition means 82, illustratively an electrical spark-producing device, project outwardly from the fuel supply apparatus 20, through an aperture 96 formed in the back end 22 of the burner housing 26, and into the interior region 55 of the burner housing 26 and the transition chamber 24.

A circular air-mixing plate 90 is coupled to the fuel nozzle 80 and the ignition means 82 and configured to help regulate the flow of combustion air into an air and fuel mixing region 68 provided inside the transition chamber 24. As shown best in FIG. 3, a funnel 69 is mounted inside burner housing 26 and configured to define the transition chamber 24 therein. The air and fuel mixing region 68 is located at one end of the funnel 69 to receive gaseous fuel discharged by fuel nozzle 80 and combustion air passed through air-mixing plate 90. The fuel supply apparatus 20 and fuel nozzle 80 cooperate to regulate the flow of gaseous fuel into the air and fuel mixing region while the air supply apparatus 28, 62, 70 and air-mixing plate 90 cooperate to regulate the flow of combustion air into the air and fuel mixing region.

Figure 4:
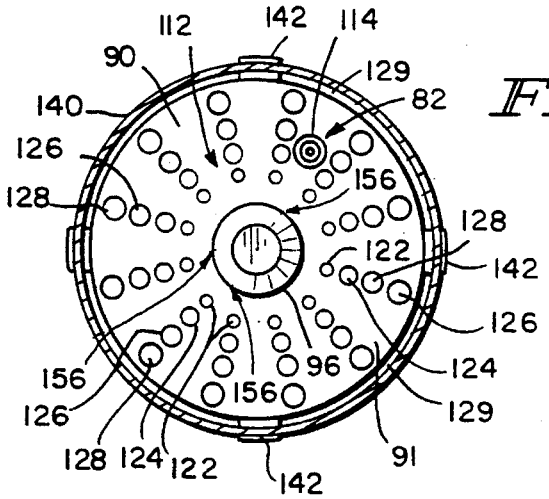
FIG. 4 is a section taken along line 4—4 of FIG. 3 showing the air-mixing plate and the pattern and size of air supply apertures formed in the air-mixing plate and arranged in rings around the gaseous fuel nozzle.

As shown in FIGS. 3 and 4, the air-mixing plate 90 is formed to include a round, thin, flat plate 91 and a circular mounting collar 92. The collar 92 projects axially outwardly from a first face 94 of the flat plate 91. The circular mounting collar 92 is formed to include a central aperture 96 for receiving the body of the fuel nozzle 80. A distal surface 98 of the mounting collar 92 engages a shoulder 100 formed in the cylindrical side wall 110 of the fuel nozzle 90. The shoulder 100 is positioned to allow an end portion 112 of the fuel nozzle 80 to project axially beyond the Second face 97 of flat plate 91 into the mixing region 68 provided in the combustion chamber 24 defined within funnel 69. The fuel nozzle 80 is attached to the air-mixing plate 90 by bolts, screws, rivets, or suitable fastening means. For example, in the illustrated embodiment, a bolt 99 couples fuel nozzle 80 to the collar 92 of air-mixing plate 90.

The flat plate 91 is also formed to include an offset aperture 114 for receiving the flame ignition means 82 as shown in FIG. 4. The flame ignition means 82 extends from the fuel supply apparatus 20 through the aperture 114 in the flat plate 91 to allow the ignition means 82 to project from the second surface 97 of the flat plate 91 into the air and fuel mixing region 68.

The air-mixing plate 90 also includes a first set of apertures 122 spaced uniformly and arranged in a first ring about the end portion 112 spaced uniformly, a second set of apertures 124 of the fuel nozzle 80 spaced uniformly and arranged in a second ring about the first ring, a third set of apertures 126 spaced uniformly and arranged in a third ring about the second ring, and a fourth set of apertures 128 spaced uniformly and arranged in a fourth ring about the third ring. The inner diameter of each aperture in sets 122, 124, 126, 128 increases as a function of the radial distance of the ring from the central aperture 96 so that each aperture in the first set of apertures 122 has the smallest inner diameter, each aperture in the second set of apertures 124 has a medium-sized inner diameter, each aperture in the third set of apertures 126 has a large-sized inner diameter, and each aperture in the fourth set of apertures 128 has a jumbo-sized diameter. For example, in a tube burner 10 firing into 3.0 inch (7.6 cm) diameter tube heat exchanger 46, apertures 122 have a 0.196 inch (0.498 cm) diameter, apertures 124 have a 0.277 inch (0.704 cm) diameter, apertures 126 have a 0.339 inch (0.861 cm) diameter, and apertures 128 have a 0.390 inch (0.991 cm) diameter.

By varying the inner diameter size of the apertures in aperture sets 122, 124, 126, 128, less pressure is required to feed a sufficient amount of combustion air into the air and fuel mixing region 68 in transition chamber 24 as compared to a plate similar to plate 90 but formed to include apertures of uniform diameter. Advantageously, this means that a lower pressure fan 28 can be used to move a sufficient amount of combustion air into the burner housing 26, thereby reducing fan size, cost, etc. considerably as compared to conventional gas-fired tube burners. The perforated air-mixing plate 90 uses a pattern of air holes of increasing size to provide a graduated amount of air to the combustion taking place in transition chamber 22 to enhance the burn fired into a small bore tube heat exchanger.

Furthermore, the jumbo-sized diameters of the fourth set of apertures 128 help to maximize the amount of funnel-cooling combustion air that is allowed to flow along the inner surface 134 of the funnel 69. This extra air flow envelope provides additional cooling in the transition chamber 24 by tending to hold the flame 230 away from the inner surface 134 of the funnel 69. Also, in the illustrated embodiment, the air-mixing plate 90 and the funnel 69 cooperate to define an annular gap 129 between an external diameter of that plate 91 and the internal diameter of that portion of the funnel 69 adjacent to the outside perimeter edge of the flat plate 91. This annular gap 129 is provided to allow even more funnel-cooling combustion air to flow along the inner surface 134 of the funnel 69 during combustion to promote desirable cooling of the funnel 69. Advantageously, it is not necessary using this burner design to mount all or part of the burner housing 26 inside the tank 12 to achieve needed cooling.

The funnel 69 provides a firing cone that is located in the interior region 55 of the burner housing 26, as shown best in FIGS. 1 and 3. Funnel 69 is a thin-walled sleeve including a conical transition section 136, a cylindrical discharge end 138, and a cylindrical intake end 140. Preferably, the conical transition section 136 converges at an angle of approximately 11° relative to its longitudinal central axis 141 from the intake end 140 to the discharge end 138. The cylindrical intake end 140 engages a circumferential shoulder 142 formed on the perimeter edge of the air-mixing plate 90. The cylindrical discharge end 138 mates with a shallow aperture 144 formed in the front end 44 of the burner housing 26 and oriented to face toward the nozzle 80. The front end 44 of the burner housing 26 is attached by bolts 45 or other suitable means to the annular flange 47 appended to the inlet end 43 of the tube heat exchanger 46.

The firing cone funnel 69 and the air-mixing plate 90 cooperate to define the transition chamber 24 in which a mixture of air provided by air supply 16 and fuel provided by fuel supply 14 is ignited by flame ignition means 82 to fire a burn into the tube heat exchanger 46 that extends into tank 12. The firing cone funnel 69 cooperates with the side wall 27 of the burner housing 26 to form a diverging annular channel for distributing combustion air around the conical perimeter of firing cone funnel 134 and into the mixing region 68 in the transition chamber 24 through the cylindrical intake end 140.

Figure 5:
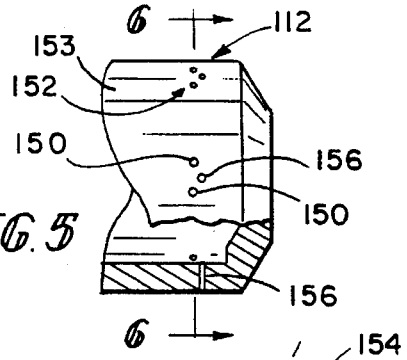
FIG. 5 is an enlarged elevation view of the head of the gaseous fuel nozzle illustrated in FIGS. 3 and 4 showing the location of three of the circumferentially spaced-apart sets of fuel discharge ports in the annular side wall of the nozzle and the arrangement of the fuel discharge ports in each set in a triangular pattern.
Figure 6:
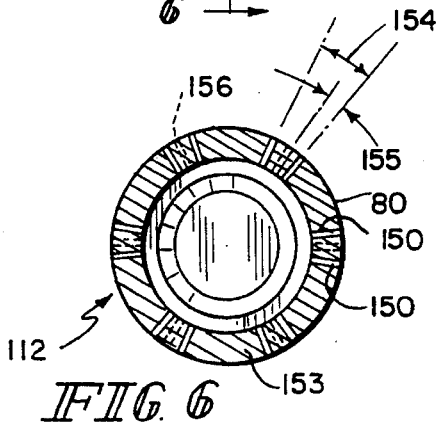
FIG. 6 is a section taken along line 6—6 in FIG. 5 showing the spacing and arrangement of fuel discharge ports about the circumference of the gaseous fuel nozzle.

The end portion 112 of the fuel nozzle 80 projects from the air-mixing plate 90 into the transition chamber 24. As shown in FIGS. 5 and 6, fuel discharge ports 150, 158 are arranged in triangular patterns 152 that are circumferentially spaced-apart on the side wall 153 of the end portion 112 of the fuel nozzle 80. Preferably, the fuel discharge ports 150, 156 provided in a fuel nozzle 80 to be used in a 3.0 inch (7.6 cm) tube burner would have a diameter of approximately 0.070 inches (0.178 cm). The orientation of the fuel discharge ports 150 causes fuel to be discharged in a plane parallel to, and spaced-apart from, the air-mixing plate 90. The plane of fuel discharge ports 150 that form the bases of the triangular patterns 152 is shown in FIG. 6, which is a sectional view taken along lines 6—6 of FIG. 5. In each triangular pattern 152, the fuel discharge ports 150 forming the base of each triangular pattern 152 are angularly spaced by a predetermined angle 154, preferably about 10°. The fuel discharge port 156, at the apex of the triangular pattern 152, lies in a plane bisecting the angle 154 thereby forming an angle 155 of 5° with the central axes of discharge ports 150.

The pattern of ports provided in fuel nozzle 80 function, when used in conjunction with air-mixing plate 90, to provide a stable, uniform flame to fit the converging transition defined by the firing cone funnel 69. By using a high fuel pressure, good turndown performance is achieved. As shown in FIG. 4, the fuel nozzle 80 is indexed relative to the air-mixing plate 90 to cause each fuel discharge port 156 to be aimed in the direction of a line bisecting the included angle defined by each adjacent radially extending line of apertures 122, 124, 126, and 128.

In a natural gas burner design, preferably six sets of three ports 150, 156 are circumferentially spaced-apart around the side wall 153 of the end portion 112 of the fuel nozzle 80. For a propane burner, three sets of three ports 150, 156 are preferred. In both cases, one set of ports 150 should be aimed at the flame ignition means 82.

The fuel supply apparatus 20, as shown in FIG. 9, is formed to include three internal passageways 74, 76, and 78 and a mounting flange 84 for attaching the fuel supply apparatus 20 to the back end 22 of the burner housing 26. These three internal passageways 74, 76, 78 cooperate to conduct fuel from the fuel supply conduit 18 to the fuel nozzle 80 so that the nozzle 80 can discharge gaseous fuel into the air and fuel mixing region 68 in the transition chamber 24. A first passageway 74 is formed in the fuel supply apparatus 20 to connect the fuel supply conduit 18 to a second passageway 76. The second passageway 76 is formed in the fuel supply apparatus 20 to lie perpendicular to the first passageway 74 and parallel to the mounting flange 84 so that it intersects a third passageway 78 connected to the fuel nozzle 80. The third passageway 78 is perpendicular to the mounting flange 84 and to the second passageway 76.

The first passageway 74 has a first end 158 that is threaded at 160 to engage one threaded end of the fuel supply conduit 18. Formed perpendicular to the mounting flange 84, the first passageway 74 extends into a second passageway 76, which connects the first passageway 74 to the third passageway 78. A first end 162 of the second passageway 76 is threaded at 164 to receive a threaded sealing plug 166. A second end 168 of the second passageway 76 opens into the third passageway 78. The third passageway 78 has a first end 170 that is threaded at 172 to receive a threaded sealing plug 167. The second end 174 of the third passageway 78 empties gaseous fuel into the fuel nozzle 80 for delivery through the fuel nozzle 80 into the air and fuel mixing region 68 in the transition chamber 24.

A cylindrical fuel control valve bore 178 is formed in the fuel supply apparatus 20 and positioned to be orthogonal to, and pass through, the first internal passageway 74 as shown in FIG. 9. Bore 178 is also aligned to lie in spaced-apart parallel relation to the second passageway 76. Bore 178 is configured to receive a valve which can be operated to regulate the flow rate of fuel through the first passageway 74 so that an operator can control the amount of gaseous fuel that is discharged by the fuel nozzle 80 into the air and fuel mixing region 68 in the transition chamber 24.

A fuel supply control valve 180, of the type shown in FIG. 8, is inserted into the fuel control valve bore 178 to assume the position shown in FIG. 9. The fuel supply control valve 180 is arranged to lie in rotative bearing engagement with the cylindrical wall defining bore 178. By rotating the fuel supply control valve 180 about its longitudinal axis 214 in bore 178, it is possible to vary the flow rate of gaseous fuel allowed to pass through the first internal passageway 74 toward the fuel nozzle 80 owing to the special shape of the central valving portion 188 of the fuel supply control valve 180. It will be apparent from the following description that the shape of the valving portion 188 can be configured so as not to shut off gas flow completely when the fuel supply control valve is in its closed position. This feature always permits the fuel nozzle 80 to discharge a small amount of fuel into the transition chamber 24 to maintain low fire therein.

As shown in more detail in FIG. 8, the fuel supply control valve 180 includes spaced-apart, cylindrical first and second journals 182 and 184 that engage first and second cylindrical bearing sections 185 and 187, respectively, provided in bore 178. A notch or slot 192 is cut into the fuel supply control valve 180 in the region between the first and second journals 182 and 184 to form a valving section 188 having a special flow control shape. Illustratively, the valving section 188 is formed to include a rectangular bottom wall 194 and two upright, semicircular, spaced-apart parallel side walls 196 and 198. An O-ring seal 199 is installed in an annular groove formed in the second journal 184 to provide a seal between the inner wall of bore 178 and the rotatable fuel supply control valve.

A drive shaft 200 is rigidly connected to one end 201 of the fuel supply control valve 180, as shown in FIGS. 8 and 9, to control rotation of the fuel supply control valve 180 in bore 178. Drive shaft 200 is arranged to extend through a passageway 202 formed in a bearing 210 which is rigidly attached to a side wall 204 of the fuel supply apparatus 20 as shown in FIG. 9. A distal end 212 of the shaft 200 is attached to a first pivot link 32 as shown in FIGS. 7 and 9. A fuel valve actuator 226 coupled to drive shaft 200 or first pivot link 32 is operable manually or by remote control to rotate drive shaft 200 about its longitudinal axis 214 causing the fuel supply control valve 180 to rotate about its longitudinal axis 214 in bore 178 between a closed position and an open position, thereby regulating the amount of fuel passing through the fuel supply apparatus 20 to the fuel nozzle 80. In the closed position, the bottom wall 194 of the valving section 188 lies perpendicular to the longitudinal axis 215 of the first passageway 74. In the fully open position, the bottom wall 194 of the valving section 188 lies parallel to the longitudinal axis 215 of the first passageway 74, thereby allowing fuel from the fuel supply conduit 18 to pass through the valving section 188 of fuel supply control valve 180 in direction 216 toward the fuel nozzle 180.

Figure 11:
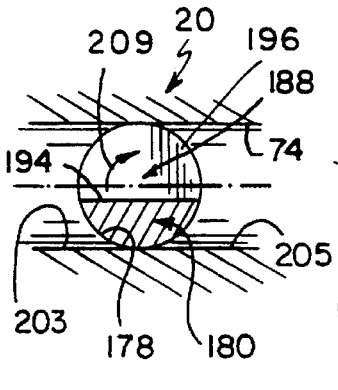
FIG. 11 is a section taken along line 11—11 in FIG. 10 showing the direction in which the fuel supply control valve is rotated to move toward its closed position.
Figure 10:
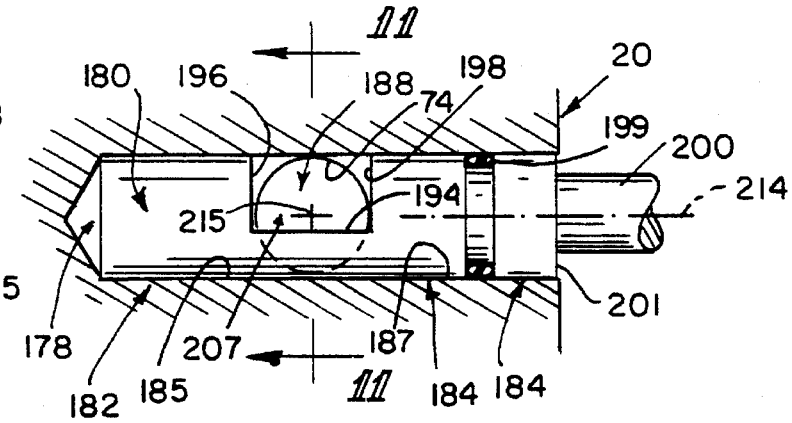
FIG. 10 is an enlarged side elevation view of the fuel supply control valve of FIG. 9 in its opened position allowing a maximum flow of gaseous fuel through the fuel supply apparatus and into the fuel nozzle.

The fuel valve actuator 226 and drive shaft 200 can be used to rotate the fuel supply control valve 180 to assume its opened position as shown, for example, in FIGS. 10 and 11. In this opened position, gaseous fuel can travel from upstream section 203 of first internal passageway 74 to downstream section 205 of first internal passageway 74 through the channel 207 bounded by the inner wall of passageway 74 and the slot 192 formed in valving section 188. When opened, the fuel supply control valve 180 permits a maximum amount of fuel to flow through the first internal passageway 74 in fuel supply apparatus 20 to fuel nozzle 80.

Figure 13:
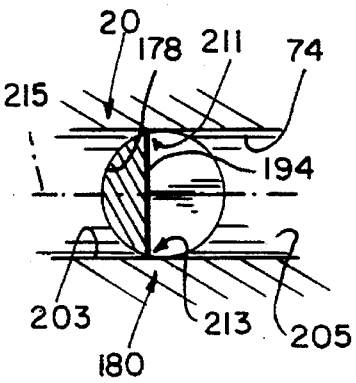
FIG. 13 is a section taken along line 13—13 in FIG. 10.
Figure 12:
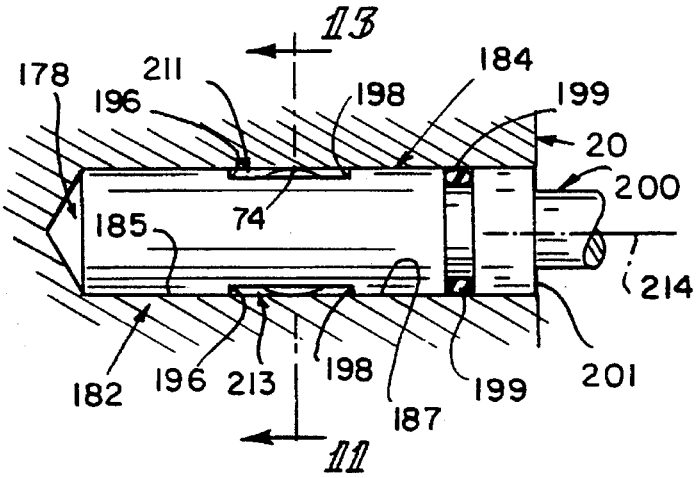
FIG. 12 is a view similar to FIG. 10 showing the fuel supply control valve in its closed position allowing a minimum flow of gaseous fuel through the fuel supply apparatus and into the fuel nozzle to sustain an idle condition in the burner at a low fire rate.

The fuel supply control valve 180 can be rotated in direction 209 (FIG. 11) to move toward the closed position shown, for example, in FIGS. 12 and 13. In this closed position, only a small amount of gaseous fuel can travel through valving section 188 from upstream passageway section 203 to downstream passageway section 205. This small amount of gaseous fuel passes through a semicircular upper channel 211 and a spaced-apart semicircular lower channel 213 as shown, for example, in FIGS. 12 and 13.

The slotted valving section 188 in fuel supply control valve 180 makes it easy for a user to idle the burner 10 at low fire rates. In many conventional burners, because of poor valving and idling capabilities, it is often necessary to turn the burner off and then reignite it when heat is later needed. The fuel supply control valve 180 is configured to make it possible to allow a predetermined amount of fuel flow through upper and lower channels 211 and 213 as shown in FIGS. 12 and 13 to maintain a low fire in burner 10. Maintaining proper combustion air and fuel ratios throughout the range of burner operation is also important as it relates to burner efficiency. Not only does valve 180 provide a proper combustion air and fuel ratio at the maximum firing rate, it also provides a proper ratio during turndown of the burner to lower firing rates. It will be understood that if a burner operates without the proper air and fuel ratio, it represents a significant waste of fuel. The new valve design also provides a maximum amount of reproducibility in production quantities.

The slot 192 formed in fuel supply control valve 180 is 0.5 inch (1.27 cm) wide by 0.31 inch (0.79 cm) deep in a 0.5 inch (1.27 cm) diameter slot. Cutting the depth of slot 192 below the center line of the valve shaft as shown best in FIGS. 10 and 11 allows for the minimum fuel flow area (e.g., upper and lower channels 211, 213) to be created when the valve 180 is in the closed position as shown in FIGS. 12 and 13.

Figure 14:
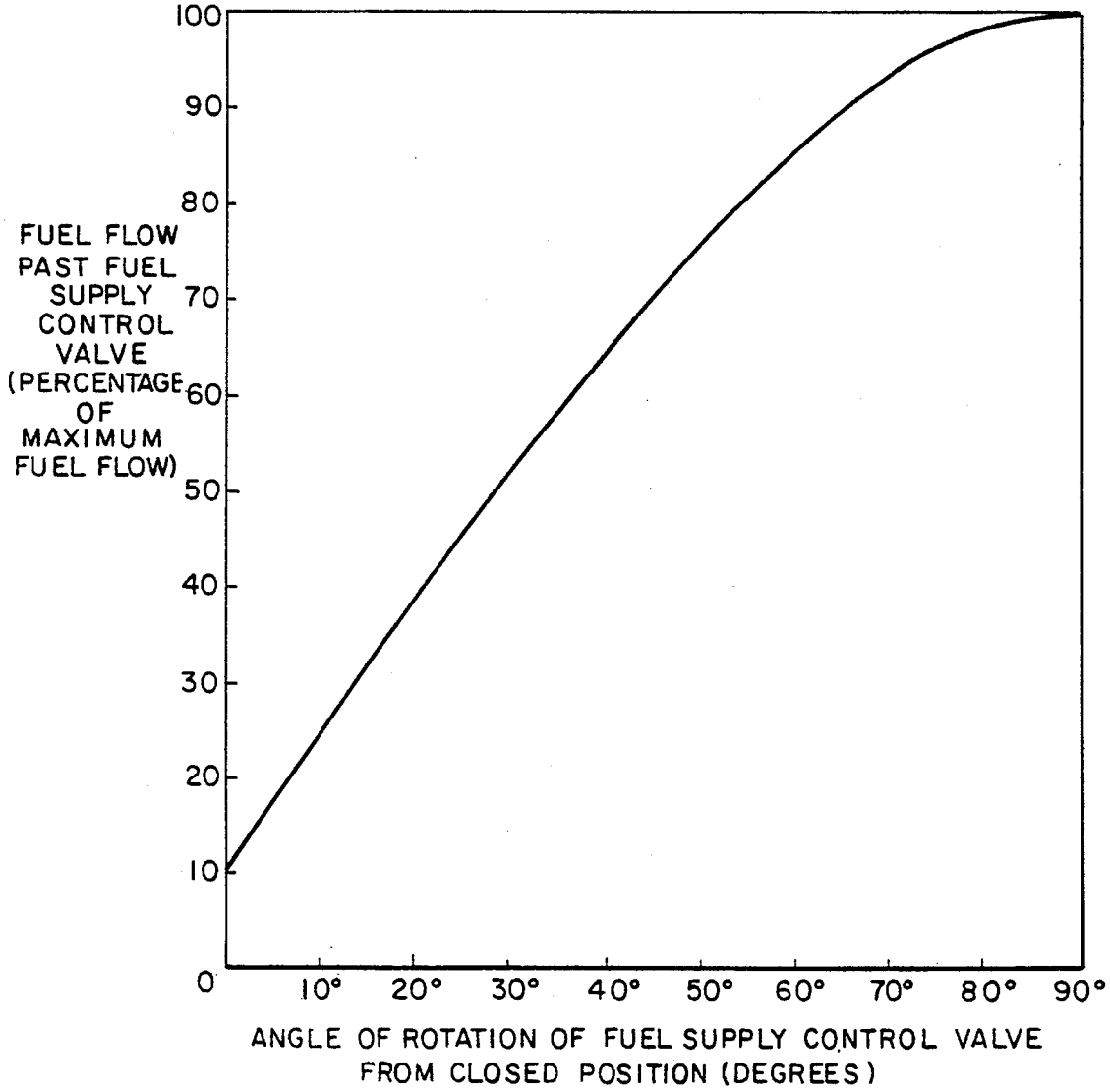
FIG. 14 is a plot showing the percentage of gaseous fuel that is permitted to flow past the fuel supply control valve of FIG. 9 as a function of the angle of rotation of the valve away from its closed position shown in FIGS. 12 and 13, thereby illustrating that a minimum of 10% fuel flow is allowed when the valve is in its closed position (FIGS. 12 and 13) and a maximum of 100% fuel flow is allowed when the valve is in its opened position (FIGS. 10 and 11)

A plot showing the available fuel flow area through valving section 188 as a function of the angle of rotation of the fuel supply control valve 180 from the closed position is illustrated in FIG. 14. At 90°, the valve 180 is in the opened position shown in FIGS. 10 and 11 and 100% of the maximum flow area through valving section 188 is available. At 0°, the valve 180 is in the closed position shown in FIGS. 12 and 13 and 10% of the maximum flow area through valving section 188 is available. This means a small amount of fuel can always pass through valve 180 to maintain the burner 10 at a low fire rate idle condition. It will be understood that it is possible to program the valve 180 to achieve a desired "flow curve" of the type shown in FIG. 14 by varying the width and depth of the slot 192 and the diameter of the valve 180 for a passageway 74 of a fixed internal diameter or cross-sectional area.

The fuel supply control valve 180 is connected by control rod 36 to the butterfly valve 70 mounted in the combustion air inlet 30 as shown in FIG. 7 to permit an operator to maintain the proper ratio of air and fuel in the transition chamber 24. The control rod 36 has a first end 222 connected to first pivot link 32 and a second end 224 connected to a second pivot link 34. The first pivot link 32 is rigidly connected to the drive shaft 200, and the second pivot link 34 is rigidly attached to a portion of the butterfly valve axle 72 which extends through the cylindrical side wall 60 of the combustion air inlet 30. When the first pivot link 32 is moved to position the fuel supply control valve 180 in the closed position, the control rod 36 positions the second pivot link 34 to close the butterfly valve 70 in the combustion air inlet 30. Moving the first pivot link 32 to position the fuel supply control valve 180 in the open position pulls the control rod 36 in a direction which actuates the second pivot link 34 to open the butterfly valve 70. Illustratively, a fuel valve actuator 226 of any suitable type is used to provide means for rotating the drive shaft 200 about its longitudinal axis 214 to control opening and closing of the fuel supply control valve 180 and the air supply butterfly valve 70 using the pivoting control linkage 32, 34, 36.

In operation, a user connects a fuel supply 14 to the fuel supply apparatus 20 using fuel supply conduit 18. The fuel valve actuator 226 is operated manually or by remote control to rotate drive shaft 200 and the fuel supply control valve 180 to control the amount of gaseous fuel flowing through the first, second, and third internal passageways 74, 76, and 78 in the fuel supply apparatus 20 and into the fuel nozzle 80. A certain amount of fuel is allowed to pass through the fuel supply apparatus 20 into the interior of the fuel nozzle 80 and then out the fuel discharge ports 150 and 156 formed in the end portion 112 of the fuel nozzle 80 into the air and fuel mixing region 68 in the transition chamber 24. By action of the pivoting linkage including first and second pivot links 32 and 34 and the control rod 36, opening the fuel supply control valve 180 causes the butterfly valve 70 to open at the same time.

Opening the butterfly valve 70 allows combustion air blown by low pressure fan 28 to pass from the air supply 16 through the air passage 62 and into the interior region 55 of the burner housing 26. The air enters the burner housing 26 and passes over and around the firing cone funnel 69 in a direction from right to left in FIG. 3, advantageously cooling the funnel 69 and the air and fuel mixture contained in the transition chamber 24 defined by the funnel 69. At the same time, the funnel 69 radiates heat into interior region 55 to warm the combustion air swirling around the funnel 69 and passing from right to left through the interior region 55 of the burner housing 26. The warmed combustion air then passes around to the cylindrical intake end 140 of the funnel 69.

The air-mixing plate 90 is mounted in the circular opening provided in the intake end 140 of funnel 69 and is formed to include an array of air supply apertures 122, 124, 126, and 128 that are sized and arranged to regulate the flow of combustion air that is allowed to pass into the air and fuel mixing region 68 in transition chamber 24. Combustion air passes through the apertures 122, 124, 126, and 128 in the air-mixing plate 90 and the annular gap 129 around the perimeter edge of the air-mixing plate 90 to cause a regulated amount of combustion air to enter the transition chamber 24. This combustion air mixes with the fuel discharged by fuel nozzle 180 to form a combustible air and fuel mixture.

The fuel and the combustion air mix uniformly in the air and fuel mixing region 68 provided in the transition chamber 24 to produce a combustible mixture that is ignited by the flame ignition means 82 to produce a flame 230. The placement of the annular gap 129, the radially spaced-apart rings of air supply apertures 122, 124, 126, 128, and the varying size of the inner diameters of the apertures 122, 124, 126, 128 cooperate to allow a standard size burner to operate in a stable manner while firing directly into a small bore tube such as tube heat exchanger 46. Incoming combustion air and fuel push the flame 230 of the burning mixture along the length of the conical transition section 136 and into the cylindrical discharge end 138. From the cylindrical discharge end 138, the burn passes through the discharge aperture 144 formed in the front end 44 of the burner housing 26 and into the tube heat exchanger 46 including the inlet end 43 and the serpentine section 49 situated in the heating tank 12 and immersed in liquid 38 contained in tank 12. Thus, combustion is actually taking place outside burner 10 and inside tube 46.

The maximum combustion air volume flow rate for a 3.0 inch (7.6 cm) burner with a packaged fan is approximately 5960 cubic feet (167 cubic meters) per hour at a pressure of 6.0 inches (15.2 cm) of water column. With an external blower (not shown), the maximum combustion air volume flow rate increases to 9,536 cubic feet (270.2 cubic meters) per hour at approximately 15 inches (38.1 cm) water column. This compares to a required pressure of approximately 35 inches (88.9 cm) of water column for a conventional burner to achieve the same thermal output.

The fuel pressure required at the burner inlet of a 3.0 inch (7.6 cm) tube burner is approximately 27 inches (68.6 cm) of water column at the maximum package fan firing rate of natural gas. Propane fuel pressure will be slightly higher. The natural gas volume flow rate on a 3.0 inch (7.6 cm) burner corresponding to the maximum combustion air volume flow rate with a packaged fan (not shown) is approximately 500 cubic feet per hour (14.2 cubic meters per hour). With an external blower (not shown), the natural gas fuel flow increases to approximately 800 cubic feet per hour (22.7 cubic meters per hour).

Some conventional small bore immersion heating systems employ a large combustion chamber coupled to a fired tube (i.e., heat exchanger) and located inside of a solution tank area to stabilize the combustion. This requires a large diameter fired tube which does not allow the washer or equipment manufacturer to place the fired tube near the bottom of the tank. The burner 10 in accordance with the invention is an improvement because it allows this type of compact construction to occur. This saves the user tank height, (size) and cost of materials (typically stainless steels).

Because the diameter of the combustion chamber in a conventional small bore immersion heating system is larger than the fired tube diameter, a larger proportion of the fuel energy is burned in that region, creating an area of concentrated heat. In washing solutions such as zinc phosphate, the phosphate will "cake" or adhere to any surfaces greater than 200° F. Because solution tanks rely on stirring equipment and convection to circulate the solution, it is not uncommon to have limited zones where high amounts of heat input cannot be tolerated because it raises the temperature of the phosphate to the caking point. Once the phosphate cakes, it acts as an insulator to the fired tube and the fired tube is destroyed since the energy released in the fired tube cannot be "taken away" by the cooler solution being heated.

The burner 10 in accordance with the present invention is an improvement over conventional small bore immersion heating systems in that the majority of the combustion is not occurring in the first or upstream section of the tube. The combustion reaction is delayed by design to give off the heat of combustion in a more gradual way so that the combustion is initiated in transition chamber 24 and then progresses and transitions gradually into tube 46 and the combustion is finished inside fired tube 46. This prevents hot spots, damage to the downstream-fired tube, and localized high temperatures in the heated solutions.

The air-mixing plate 90 and transition chamber 24 combine to accomplish this delaying of the combustion reaction. First, the air holes 122, 124, 126, and 128 are distributed from smaller to larger to allow only a small portion of the combustion reaction to begin inside transition chamber 24. As the gas ejects from the gas nozzle 80, it encounters a gradually increasing amount of combustion air. The result is that only a small stabilizing portion of the fuel begins to burn inside transition chamber 24. The rest of the fuel burn is delayed until the air and fuel mixture is beyond the transition chamber 24 and into the required fired tube diameter in fired tube 46. If the majority of the fuel were allowed to burn before exiting the transition chamber 24, as is the case in some conventional small bore immersion heating systems, then several problems could arise as described below.

When fuel and air combine and are burned, there is a tremendous expansion in the volume of the mixture. For example, a natural gas/air mixture at ambient temperatures will expand to six times its volume when burned. If this expansion begins or takes place inside of a conventional combustion chamber in a conventional small bore immersion tube heating system, it would require a very high combustion air fan pressure (of the type disclosed in U.S. Pat. No. 4,014,316 to Jones et al) to overcome the back pressure of forcing that expanded gas into the reduced area of the fired tube. In the immersion-fired tube burner market, this is a serious disadvantage. The burner 10 in accordance with the present invention, on the other hand, does not allow the combustion reaction to progress to the point that high back pressures are generated. Instead, due to the delayed burn design, only a stabilizing portion of gas is burned inside transition chamber 24. The smaller amount of heat energy does not expand the mixture volume to the point of creating high back pressures when "necking down" to the fired tube 46. Illustratively, the funnel 69 defining transition chamber 24 "floats" insider burner housing 26, meaning it is not permanently attached at any point. This allows funnel 69 to expand and contract without breaking the surrounding housing 26 or air-mixing plate 90.

Figure 15:
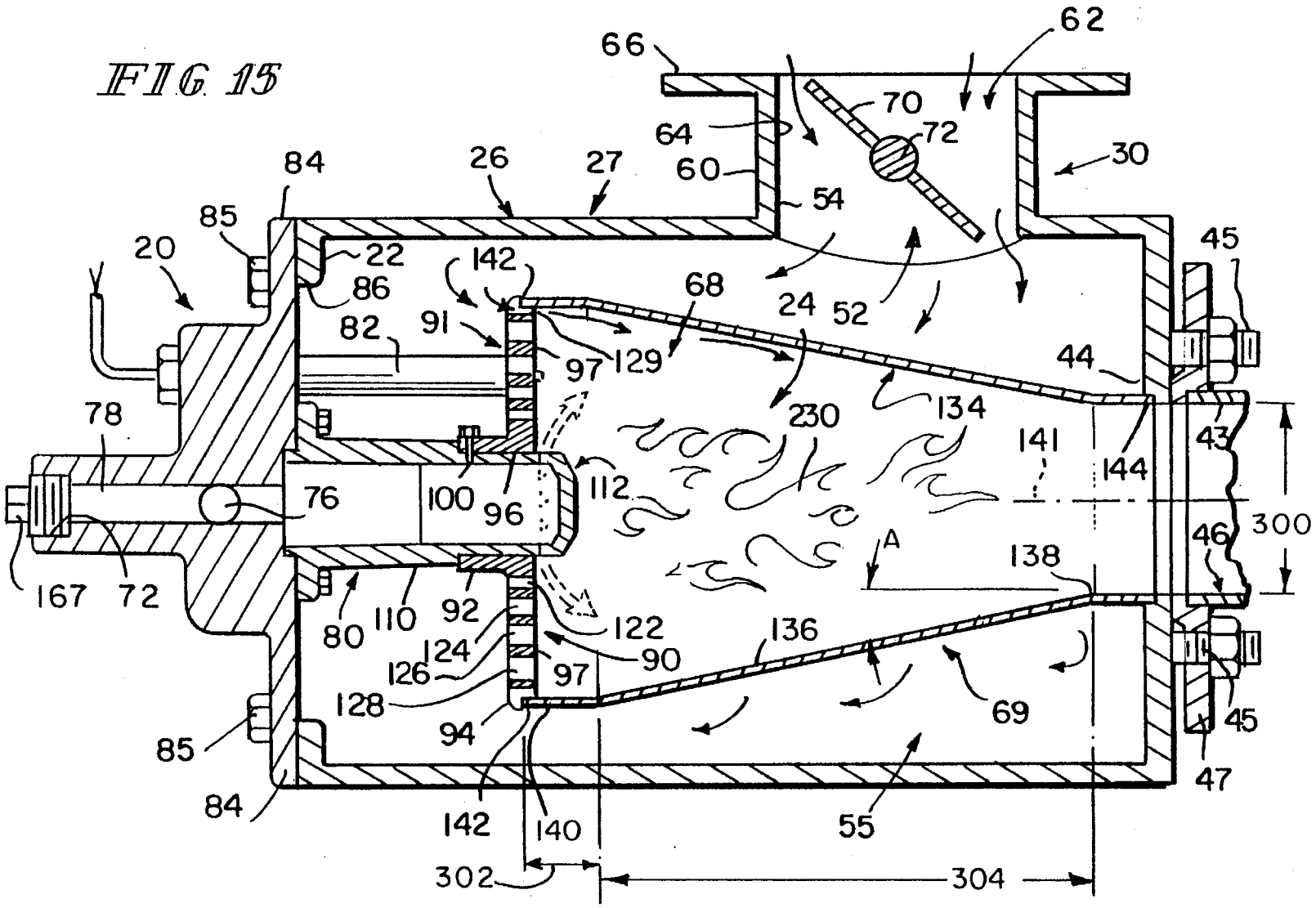
FIG. 15 is a view similar to FIG. 3 illustrating critical dimensions of the funnel which defines the transition chamber.

Advantageously, the burner 10 produces high outputs without using an expensive in-tank combustion chamber. The burner 10 as described above uses direct burner-to-tube firing to allow for uniform heat transfer and to eliminate hot spots. The high-output burner 10 includes a burner-mounted low horsepower blower. As shown in FIG. 15, each burner 10 includes a funnel 69 configured to define transition chamber 24. The funnel 69 is defined by several key dimensions including "fired-tube internal" diameter 300 at discharge opening 144, effective length of cylindrical straight section 302 in intake end 140, and effective length of the conical side wall along the central axis of the funnel 304. Illustratively, the fired tube internal diameter is the outlet end of the thin-walled funnel and defines an opening that is equivalent to the internal diameter of tube 46. In presently preferred embodiments, key dimensions for funnels 69 in two, three, four, six, and eight inch burners 10 are set forth below. In each of these embodiments, a low-pressure combustion air fan operating at a pressure of six inches of water column is used.

EXAMPLES

A. TWO INCH BURNER:

Fired-Tube Internal Diameter (300)=2.00 inch (5.08 cm)

Length of Cylindrical Straight Section (302)=1.00 inch (2.54 cm)

Effective Length of Funnel (304)=7.75 inch (19.7 cm)

Ratio of 304 to 302=7.75

Ratio of 304 to 300=3.875

Ratio of 302 to 300=0.50

B. THREE INCH BURNER:

Fired-Tube Internal Diameter (300)=3.00 inch (7.6 cm)

Length of Cylindrical Straight Section (302)=1.00 inch (2.54 cm)

Effective Length of Funnel (304)=7.75 inch (19.7 cm)

Ratio of 304 to 302=7.75

Ratio of 304 to 300=2.58

Ratio of 302 to 300=0.33

C. FOUR INCH BURNER:

Fired-Tube Internal Diameter (300)=4.00 inch (10.2 cm)

Length of Cylindrical Straight Section (302)=1.0 inch (2.54 cm)

Effective Length of Funnel (304)=8.75 inch (22.2 cm)

Ratio of 304 to 302=8.75

Ratio of 304 to 300=2.19

Ratio of 302 to 300=0.25

D. SIX INCH BURNER:

Fired-Tube Internal Diameter (300)=6.00 inch (15.2 cm)

Length of Cylindrical Straight Section (302)=1.0 inch (2.54 cm)

Effective Length of Funnel (304)=10.0 inch (25.4 cm)

Ratio of 304 to 302=10.0

Ratio of 304 to 300=1.67

Ratio of 302 to 300=0.167

E. EIGHT INCH BURNER:

Fired-Tube Internal Diameter (300)=8.00 inch (20.3 cm)

Length of Cylindrical Straight Section (302)=1.00 inch (2.54 cm)

Effective Length of Funnel (304)=10.95 inch (27.8 cm)

Ratio of 304 to 302=10.95

Ratio of 304 to 300=1.37

Ratio of 302 to 300=0.125

Although the invention has been described in detail with reference to a certain preferred embodiment, variations and modifications exist within the scope and spirit of the invention as described and defined in the following claims.

I claim:

1. A burner assembly for combining air and fuel to produce a burn firing into a tube, the burner assembly comprising a transition section formed to include an inlet end, an outlet end, and a mixing region communicating with the inlet and outlet end, the transition section including a conical side wall converging from the inlet end toward the outlet end to fire a burn produced in the mixing region into a tube positioned at the outlet end of the transition section, means for supplying a gaseous fuel to the mixing region in the transition section, means for introducing combustion air to the mixing region through the inlet end of the transition section to mix with the gaseous fuel in the mixing region to produce a combustible mixture, the introducing means includes an air-mixing plate positioned in the inlet end of the transition section and formed to include a plurality of air supply apertures passing combustion air into the mixing region, means for mounting the air-mixing plate in a position touching the inlet end of the transition section and supporting the inlet end of the transition section against axial movement along the longitudinal axis of the transition section relative to the air-mixing plate without restricting radial movement of the inlet end of the transition section relative to the air-mixing plate in radial directions relative to the longitudinal axis of the transition section so that the inlet end of the transition section may freely float to expand in said radial directions during combustion of the combustible mixture in the mixing region, and means for coupling the tube positioned at the outlet end of the transition section to the outlet end of the transition section.

2. The burner assembly of claim 1, wherein the introducing means includes a burner housing formed to include a discharge outlet and an interior region containing combustion air, the transition section is located in the interior region of the burner housing to position the air-mixing plate in the interior region so that combustion air in the interior region is supplied into the mixing region through the air supply apertures in the air-mixing plate, the tube positioned at the outlet end of the transition section is located outside of the interior region of the burner housing, and the outlet end of the transition section extends into the discharge outlet of the burner housing so that a burn produced in the mixing region of the transition section is fired into the tube positioned outside the burner housing at the discharge outlet.

3. The burner assembly of claim 2, wherein the mounting means includes a circumferential shoulder positioned around the perimeter edge of the air-mixing plate, the discharge outlet of the burner housing is formed to include a shallow aperture, the inlet end of the transition section engages the circumferential shoulder and the outlet end of the transaction section extends into the shallow aperture and engages the burner housing.

4. The burner assembly of claim 2, wherein the burner housing is formed to include an air supply inlet and the transition section is mounted in the interior region of the burner housing to position the conical side wall in close proximity to and facing toward the air supply inlet.

5. The burner assembly of claim 4, wherein the burner housing includes a wall surrounding the conical side wall of the transition section to define channel means for distributing combustion air admitted into the interior region through the air supply inlet around the periphery of the conical side wall to cool a combustible mixture in the mixing region in the transition section and for conducting combustion air into the mixing region in the transition section only through the air supply apertures formed in the air-mixing plate mounted in the inlet end of the transition section.

6. The burner assembly of claim 4, wherein the burner housing includes a rear wall, a front wall, and a side wall extending between the front and rear wall, the front wall is formed to include the discharge outlet and means for supporting the outlet end of the transition section in the discharge outlet, and the supplying means is coupled to the rear wall and the air-mixing plate to support the inlet end of the transition section in the interior region of the burner housing facing toward the rear wall.

7. The burner assembly of claim 4, wherein the burner housing includes a rear wall, a front wall, and a side wall extending between the front and rear wall, the front wall is formed to include the discharge outlet, and the side wall of the burner housing is positioned to surround the conical side wall of the transition section and is formed to include the air supply inlet.

8. The burner assembly of claim 1, wherein the supplying means includes a nozzle extending into the mixing region through an aperture formed in the air-mixing plate.

9. A burner assembly for combining air and fuel to produce a burn firing into a tube heating a solution tank formed to include an interior solution-containing region, the burner assembly comprising a funnel formed to include an inlet end, an outlet end, and a mixing region communicating with the inlet and outlet end, the funnel including a conical side wall converging from the inlet end toward the outlet end to fire a burn produced in the mixing region into a tube coupled to the outlet end of the funnel and extended into the interior solution-containing region of the solution tank, means for supplying a gaseous fuel to the mixing region in the funnel, means for introducing combustion air into the mixing region through the inlet end in the funnel to mix with the gaseous fuel in the mixing region to produce a combustible mixture, the introducing means includes an air-mixing plate mounted in the inlet end of the funnel and formed to include a plurality of air supply apertures passing combustion air into the mixing region, and means for mounting the funnel in a position outside and away from the interior solution-containing region of the solution tank, the supplying means including a nozzle extending into the mixing region through an aperture formed in the air-mixing plate, the nozzle including an annular portion situated in the mixing region and formed to include a plurality of circumferentially spaced-apart sets of fuel discharge ports, each set of fuel discharge ports including three fuel discharge ports formed in the annular portion and arranged in a triangular pattern.

10. The burner assembly of claim 9, wherein the air-mixing plate includes a plurality of circumferentially spaced-apart radially extending lines of apertures and one of the three fuel discharge ports in each set of fuel discharge ports formed in the annular portion is positioned to be aimed in the direction of a line bisecting the included angle defined by each adjacent radially extending line of air supply apertures.

11. The burner assembly of claim 9, wherein the air-mixing plate is formed to include a central aperture receiving the supplying means and a plurality of sets of circumferentially spaced-apart air supply apertures ringing around the central aperture passing combustion air into the mixing region, a first of the sets includes a plurality of air supply apertures having first internal diameters, a second of the sets includes a plurality of air supply apertures ringing around the first of the sets and having second internal diameters larger than the first internal diameters, and the fuel discharge ports means are positioned in the mixing region to lie between the air supply apertures formed in the air-mixing plate and the outlet end of the funnel.

12. The burner assembly of claim 11, wherein a third of the sets includes a plurality of air supply apertures ringing around an outside edge of the second of the sets and having third internal diameters larger than the first and second diameters.

13. A burner assembly for combining air and fuel to produce a burn firing into a tube, the burner assembly comprising a transition section formed to include an inlet end, an outlet end, and a mixing region communicating with the inlet and outlet end, the transition section including a conical side wall converging from the inlet end toward the outlet end to fire a burn produced in the mixing region into a tube positioned at the outlet end of the transition section, means for supplying a gaseous fuel to the mixing region in the transition section, means for introducing combustion air to the mixing region through the inlet end of the transition section to mix with the gaseous fuel in the mixing region to produce a combustible mixture, the introducing means includes an air-mixing plate positioned in the inlet end of the transition section and formed to include a plurality of air supply apertures passing combustion air into the mixing region, means for mounting the air-mixing plate in a position touching the inlet end of the transition section and supporting the transition section against movement along the longitudinal axis of the transition section without restricting movement of the transition section relative to the air-mixing plate in radial directions relative to the longitudinal axis of the transition section so that the inlet end may freely expand during combustion, and means for mating the tube positioned at the outlet end, the supplying means including a nozzle extending into the mixing region through an aperture formed in the air-mixing plate, the nozzle including an annular portion situated in the mixing region and formed to include a plurality of circumferentially spaced-apart sets of fuel discharge ports, each set of fuel discharge ports including three fuel discharge ports formed in the annular portion and arranged in a triangular pattern.

14. The burner assembly of claim 13, wherein the air-mixing plate includes a plurality of circumferentially spaced-apart radially extending lines of apertures and one of the three fuel discharge ports in each set of fuel discharge ports formed in the annular portion is positioned to be aimed in the direction of a line bisecting the included angle defined by each adjacent radially extending line of air supply apertures.

15. A burner assembly for combining air and fuel to produce a burn firing into a tube, the burner assembly comprising a transition section formed to include an inlet end, an outlet end, and a mixing region communicating with the inlet and outlet end, the transition section including a conical side wall converging from the inlet end toward the outlet end to fire a burn produced in the mixing region into a tube positioned at the outlet end of the transition section, means for supplying a gaseous fuel to the mixing region in the transition section, means for introducing combustion air into the mixing region through the inlet end of the transition section to mix with the gaseous fuel in the mixing region to produce a combustible mixture, the introducing means including an air-mixing plate mounted in the inlet end of the transition section, the air-mixing plate being formed to include a central aperture receiving the supplying means and a plurality of sets of circumferentially spaced-apart air supply apertures ringing around the central aperture passing combustion air into the mixing region, a first of the sets including a plurality of air supply apertures having first internal diameters, a second of the sets including a plurality of air supply apertures ringing around the first of the sets and having second internal diameters larger than the first internal diameters, the supplying means including a nozzle extending into the mixing region through an aperture formed in the air-mixing plate, the nozzle being formed to include fuel discharge port means for discharging gaseous fuel from the nozzle into the mixing region, and the fuel discharge port means being positioned in the mixing region to lie between the air supply apertures formed in the air-mixing plate and the outlet end of the transition section, the nozzle including an annular portion situated in the mixing region, the fuel discharge port means including a plurality of circumferentially spaced-apart sets of fuel discharge ports, and each set of fuel discharge ports including three fuel discharge ports formed in the annular portion and arranged in a triangular pattern.

16. The burner assembly of claim 15, wherein the air-mixing plate includes a plurality of circumferentially spaced-apart radially extending lines of air supply apertures, each of the radially extending lines of air supply apertures includes one air supply aperture from said first of the sets and one air supply aperture from said second of the sets, and one of the three fuel discharge ports in each set of fuel discharge ports formed in the annular portion is positioned to be aimed in the direction of a line bisecting the included angle defined by each adjacent radially extending line of air supply apertures.

17. A burner assembly for combining air and fuel to produce a burn firing into a tube, the burner assembly comprising a transition section formed to include an inlet end, an outlet end, and a mixing region communicating with the inlet and outlet end, the transition section including a conical side wall converging from the inlet end toward the outlet end to fire a burn produced in the mixing region into a tube positioned at the outlet end of the transition section, means for supplying a gaseous fuel to the mixing region in the transition section, means for introducing combustion air into the mixing region through the inlet end of the transition section to mix with the gaseous fuel in the mixing region to produce a combustible mixture, the introducing means including an air-mixing plate mounted in the inlet end of the transition section, the air-mixing plate being formed to include a central aperture receiving the supplying means and a plurality of sets of circumferentially spaced-apart air supply apertures ringing around the central aperture passing combustion air into the mixing region, a first of the sets including a plurality of air supply apertures having first internal diameters, a second of the sets including a plurality of air supply apertures ringing around the first of the sets and having second internal diameters larger than the first internal diameters, the supplying means including a nozzle extending into the mixing region through an aperture formed in the air-mixing plate, the nozzle being formed to include fuel discharge port means for discharging gaseous fuel from the nozzle into the mixing region, and the fuel discharge port means being positioned in the mixing region to lie between the air supply apertures formed in the air-mixing plate and the outlet end of the transition section, a third of the sets including a plurality of air supply aperture ringing around an outside edge of the second of the sets and having third internal diameters larger than the first and second diameters, the nozzle including an annular portion situated in the mixing region, the fuel discharge port means including a plurality of circumferentially spaced-apart sets of fuel discharge ports, and each set of fuel discharge ports including three fuel discharge ports formed in the annular portion and arranged in a triangular pattern, the air-mixing plate including a plurality of circumferentially spaced-apart radially extending lines of air supply apertures, each of the radially extending lines of air supply apertures including one air supply aperture from said first of the sets and one air supply aperture from said second of the sets, and one air supply aperture from said third of the sets and one of the three fuel discharge ports in each set of fuel discharge ports formed in the annular portion being positioned to be aimed in the direction of a line bisecting the included angle defined by each adjacent radially extending line of air supply apertures.

* * * * *